US007814817B1

(12) United States Patent
Sheriff

(10) Patent No.: US 7,814,817 B1
(45) Date of Patent: Oct. 19, 2010

(54) MANUAL SETTING AND FORMING TOOLS

(75) Inventor: Timothy W. Sheriff, Duluth, MN (US)

(73) Assignee: Swanstrom Tools USA Inc., Superior, WI (US)

( * ) Notice: Subject to any disclaimer, the term of this patent is extended or adjusted under 35 U.S.C. 154(b) by 370 days.

(21) Appl. No.: 11/969,798

(22) Filed: Jan. 4, 2008

Related U.S. Application Data

(60) Provisional application No. 60/883,928, filed on Jan. 8, 2007.

(51) Int. Cl.
*B25B 7/02* (2006.01)
*B25B 7/04* (2006.01)
*B21F 3/00* (2006.01)

(52) U.S. Cl. ..... 81/423; 81/422; 81/424; 81/389; 81/398; 140/102.5

(58) Field of Classification Search ..... 81/389, 81/398, 422–424; 140/102.5
See application file for complete search history.

(56) References Cited

U.S. PATENT DOCUMENTS 1,353,847 A * 9/1920 Parker ..... 81/384
1,483,497 A * 2/1924 Whitfield ..... 81/349
2,398,209 A * 4/1946 Clemens ..... 81/350
2,606,471 A * 8/1952 Kollweck ..... 81/415
2,857,792 A 10/1958 McNish
3,174,517 A 3/1965 Wilson
3,360,018 A 12/1967 Lindsay
3,847,189 A 11/1974 Guzda
3,861,430 A * 1/1975 Story ..... 140/106
4,221,118 A 9/1980 Chicckine
5,277,231 A 1/1994 Dostalek
5,630,345 A * 5/1997 Ciccotelli ..... 81/373
5,632,086 A 5/1997 Helwig
5,878,788 A 3/1999 Gurry
5,987,752 A 11/1999 Swanstrom, Jr.
6,009,583 A 1/2000 Swanstrom, Jr.
6,108,878 A 8/2000 Adell
6,386,076 B1 5/2002 Swanstrom, Jr.
6,408,724 B1 6/2002 Whiteford
6,612,206 B1 9/2003 Heggemann et al.
6,658,971 B2 12/2003 Delbrugge, Jr. et al.
6,662,690 B1 12/2003 Ploeger
6,694,841 B2 2/2004 Kesinger
6,708,588 B2 3/2004 Kesinger et al.
6,721,983 B2 4/2004 Dallas et al.

(Continued)

OTHER PUBLICATIONS

"How to Make Basic Wire Earrings", eHow.com 1999-2006, http://www.ehow.com/how_18139_make-basic-wire.html, 3 pages, Mar. 31, 2006.
Easy Ear Wire Jig product description, Contenti, http://www.contenti.com/products/beading-supplies/540-213.html, 1 page, Mar. 31, 2006.
EZ Earring product description, http://www.bosbeads.com/EZ_Earring.html, 4 pages, Mar. 31, 2006.
Rio Grande publication, pp. 19-21, and 1 unnumbered page.

*Primary Examiner*—Bryan R Muller
(74) *Attorney, Agent, or Firm*—Faegre & Benson LLP

(57) ABSTRACT

The present invention is directed to kit or assembly of hand-held jewelry tools. The kit includes a least one pair of handles and one or more pairs of interchangeable jaws. Each set of jaws when attached to the pair of handles is adapted to perform a particular jewelry task. Because the kit includes a variety of interchangeable sets of jaws, it is possible to perform many different jewelry making tasks using the present kit.

21 Claims, 18 Drawing Sheets

U.S. PATENT DOCUMENTS

| | | | |
|---|---|---|---|
| 6,748,830 | B1 | 6/2004 | Swanstrom, Jr. |
| 6,862,962 | B1 | 3/2005 | Delbrugge, Jr. et al. |
| 6,941,844 | B2 | 9/2005 | Hile |
| 6,973,859 | B2 | 12/2005 | Noniewicz |
| 7,032,627 | B1 | 4/2006 | Sheriff |
| 7,343,939 | B1 | 3/2008 | Sheriff |

* cited by examiner

MANUAL SETTING AND FORMING TOOLS

CROSS REFERENCE TO RELATED APPLICATION

This application claims the benefit of U.S. Provisional Application No. 60/883,928 filed Jan. 8, 2007, the entire contents of which are hereby incorporated by reference.

FIELD OF THE INVENTION

This invention relates to the field of hand tools, particularly special purpose pliers, designed for setting and forming procedures that are used to make jewelry.

BACKGROUND OF THE INVENTION

Special purpose pliers have been used for setting and/or forming different types of materials, such as jewelry and wire products such as chain mail and jump rings. Such special purpose pliers often have had fixed jaws to accomplish a specific setting or forming process or task. Since these special purpose pliers are dedicated to a specific task, a number of different tools are needed to perform a variety of setting and forming tasks associated with making jewelry.

SUMMARY OF THE INVENTION

The present invention is directed to kit or assembly of hand-held jewelry tools. The kit includes a least one pair of handles and one or more pairs of interchangeable jaws. Each set of jaws when attached to the pair of handles is adapted to perform a particular jewelry task. Because the kit includes a variety of interchangeable sets of jaws, it is possible to perform many different jewelry making tasks using the present kit.

In one embodiment of the invention, a set of interchangeable jaws includes one fixed jaw and one moveable jaw. The movable jaw contains an adjustment member that controls a gripping angle between the pair of jaws when they are closed to contact a work piece between the jaws. Since the gripping angle can be controlled by the adjustment member, it is possible for the user to adjust the clamping surfaces or faces of the jaws so that the clamping surfaces are substantially parallel when the jaws are closed to contact a work piece positioned between them.

In other embodiments of the invention, the pair of jaws can be shaped or configured to perform a variety of jewelry making tasks such as but no limited to setting stones retained in earrings and rings or setting rivets or other similar types of fasteners. In still other embodiments of the invention, the pair of jaws can be shaped or configured for forming a work piece, such as wire, into different shapes including but not limited to, forming wire earrings, wire spirals, or straight and tapered wire coils.

DETAILED DESCRIPTION OF THE INVENTION

Referring to the Figures, and most particularly to FIGS. 1 to 13, various setting and wire forming tools of the present hand-held jewelry tool kit are illustrated.

Figure 1:
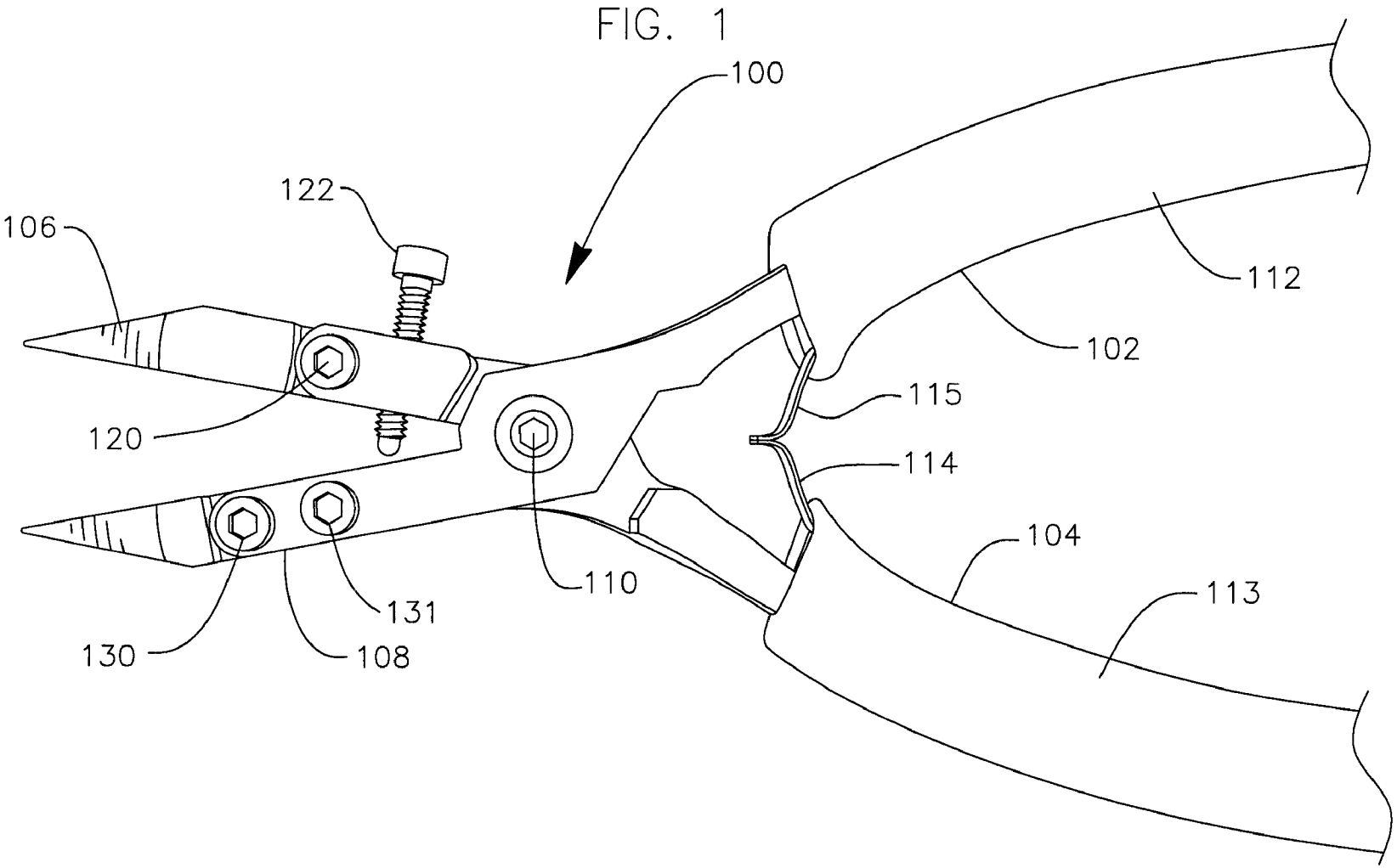
FIG. 1 is a digital image of flat nose pliers of the present invention.

In particular, FIG. 1 is a forming tool with flat nose upper and lower jaws. In this embodiment, the forming tool 100 has a pair of handles 102, 104 (in each of the illustrated embodiments described below, the pair of handles are identical) and interchangeable upper and lower jaws 106, 108. A tab portion, not illustrated, in a proximal region of each jaw is adapted to slide into a respective slot in each distal end region of both handles. The tool 100 has a pivot mechanism 110 movably joining the pair of handles and may have handle covers 112, 113 and springs 114, 115 to urge the pair of jaws 106, 108 open, as a convenience to the user. Further, upper jaw 106 has a second pivot mechanism 120 in the distal region of the handle which allows the gripping angle between the upper and lower jaws to be adjusted within a range provided by adjustment mechanism 122. In this embodiment, the adjustment mechanism is a threaded bolt or thumb screw that can be moved within a threaded bore located in a region of the jaw that is proximal of the second pivot mechanism 120. Finally, lower jaw 108 is fixed to the handle with a pair of removable fasteners 130, 131.

Figure 2:
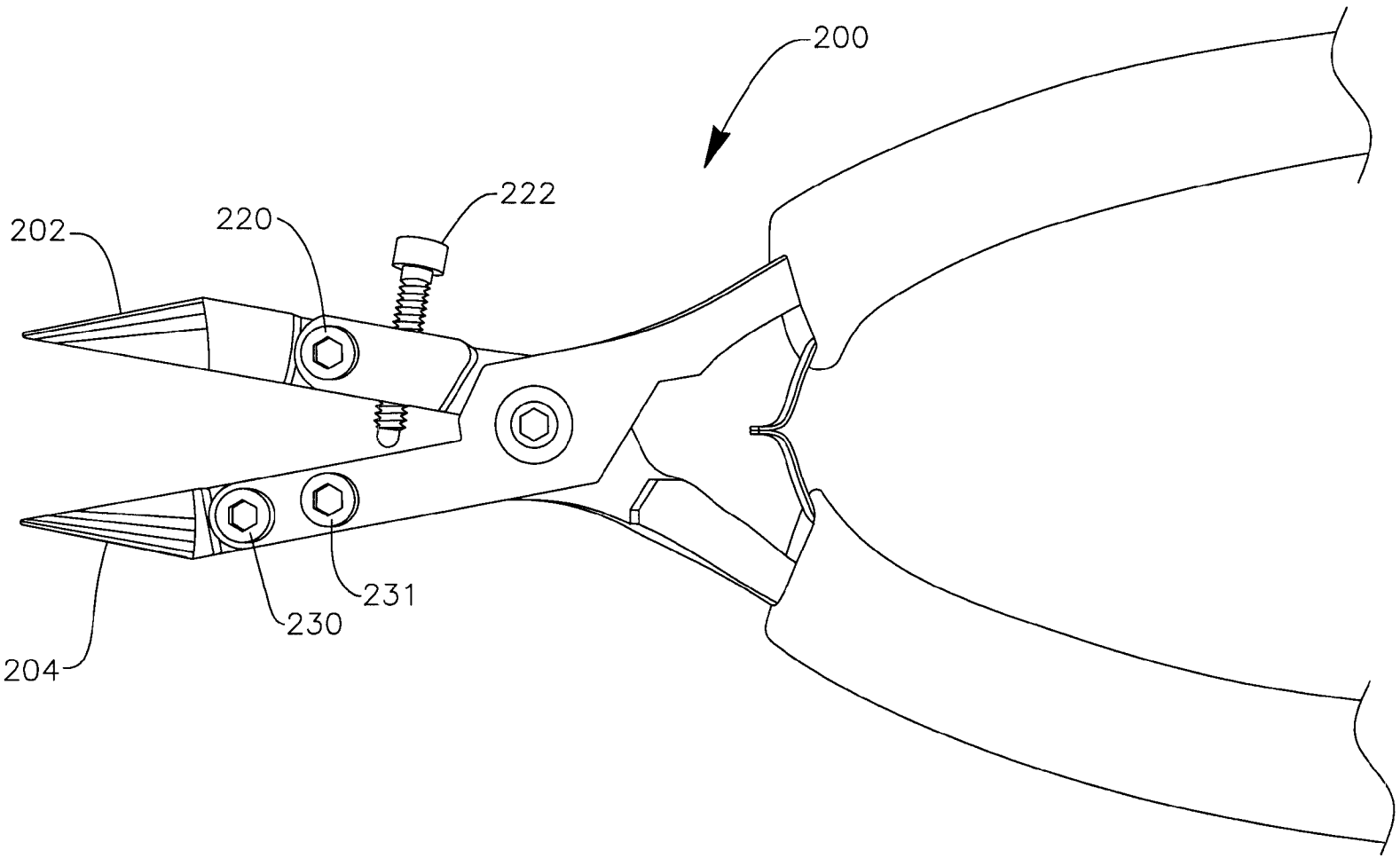
FIG. 2 is a digital image of a chain nose pliers of the present invention.

Referring now to FIG. 2, another embodiment of a forming tool of the present invention is illustrated. This forming tool 200 has chain nose upper and lower jaws 202, 204. In this type of jaw configuration, the non-clamping faces of the jaws are rounded and have a generally semi-circular or D-shaped cross section. Upper jaw 202 also has a second pivot mechanism 220 which allows the gripping angle between the upper and lower jaws to be adjusted within the range provided by adjustment mechanism 222. Lower jaw 204 is also fixed to the handle with a pair of removable fasteners 230, 231.

Figure 3:
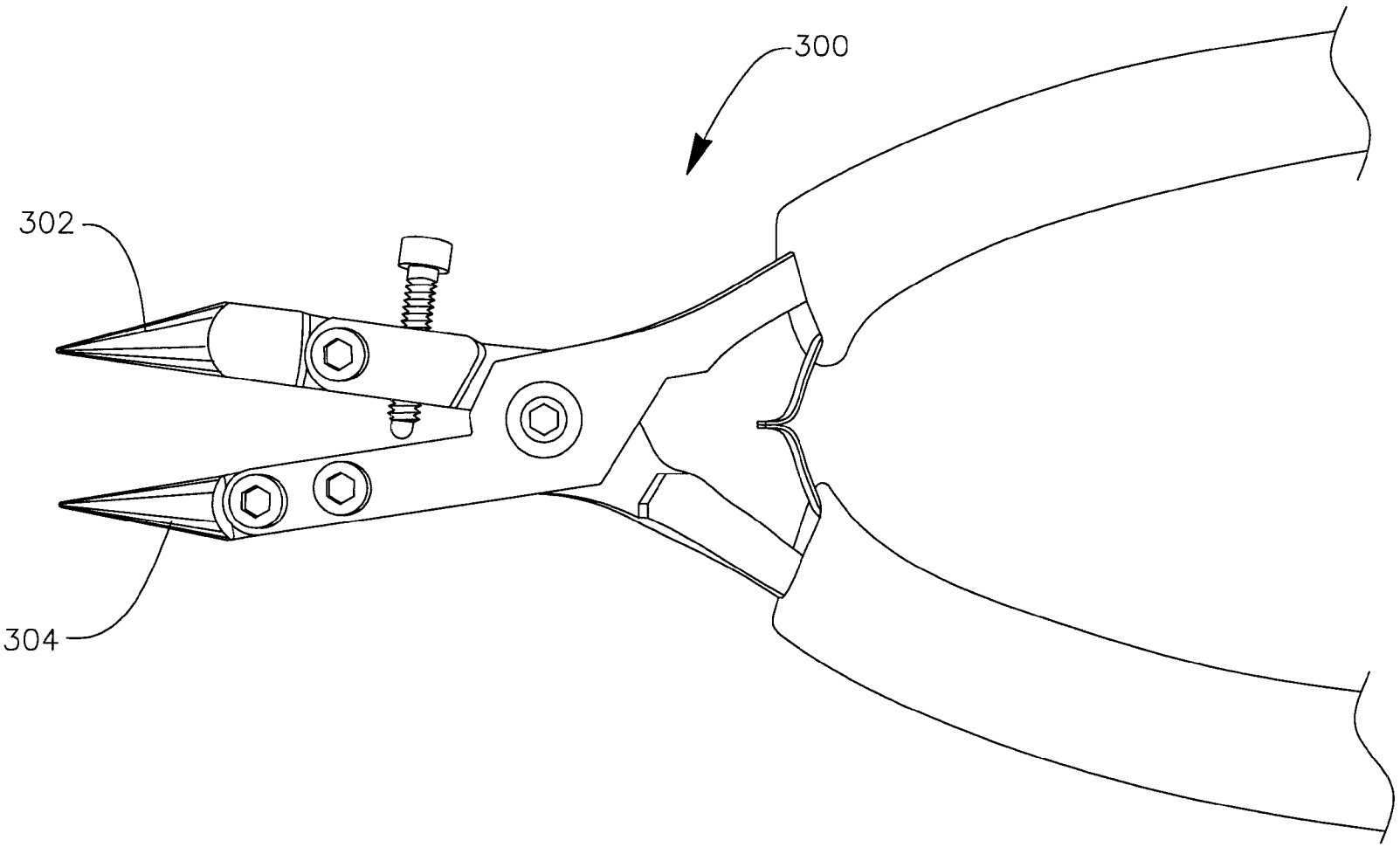
FIG. 3 is a digital image of a round nose pliers of the present invention.

Referring now to FIG. 3, another embodiment of a forming tool of the present invention is illustrated. This forming tool 300 has round nose upper and lower jaws 302, 304. In this type of jaw configuration, the cross section of both of the jaws is circular and the jaws are generally configured as tapered cylinders without any opposed flats on the jaws. The upper and lower jaws are attached to the handles in the same fashion as the upper and lower jaws of FIGS. 1 and 2.

Although FIGS. 1 to 3 refer to only flat, chain round nosed shaped upper and lower jaws, various cross-sectional shapes for the upper and lower jaws may be used in alternative embodiments and it is to be understood that other curved and polygonal cross sectional shapes, as well as various different combinations of shapes or configurations, may be used in these alternative embodiments.

Figure 4A:
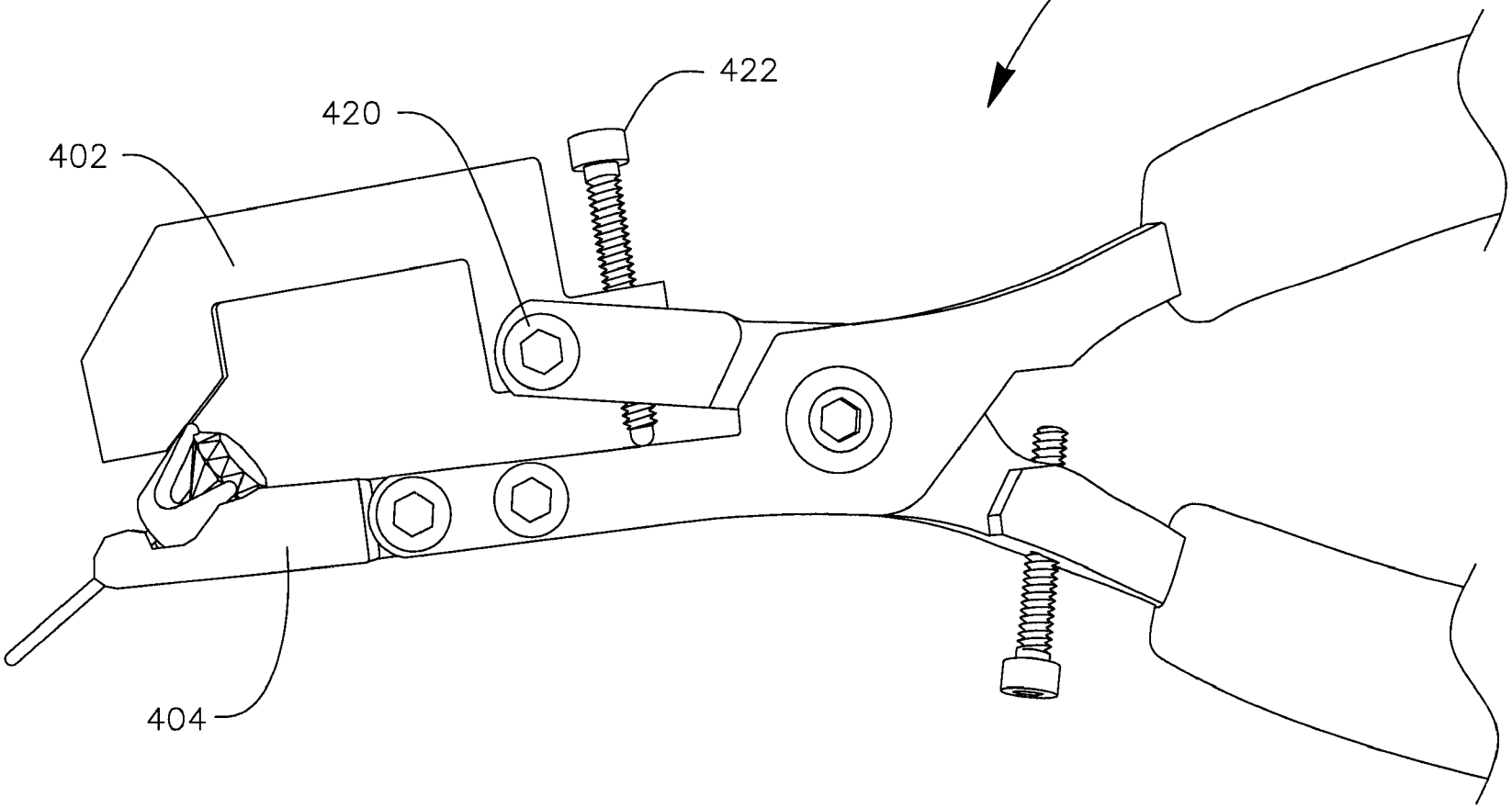
FIGS. 4*a* and 4*b* are digital images of setting tools of the present invention with a flat or straight lower clamping face that may be slotted to receive an earring post.
Figure 4B:
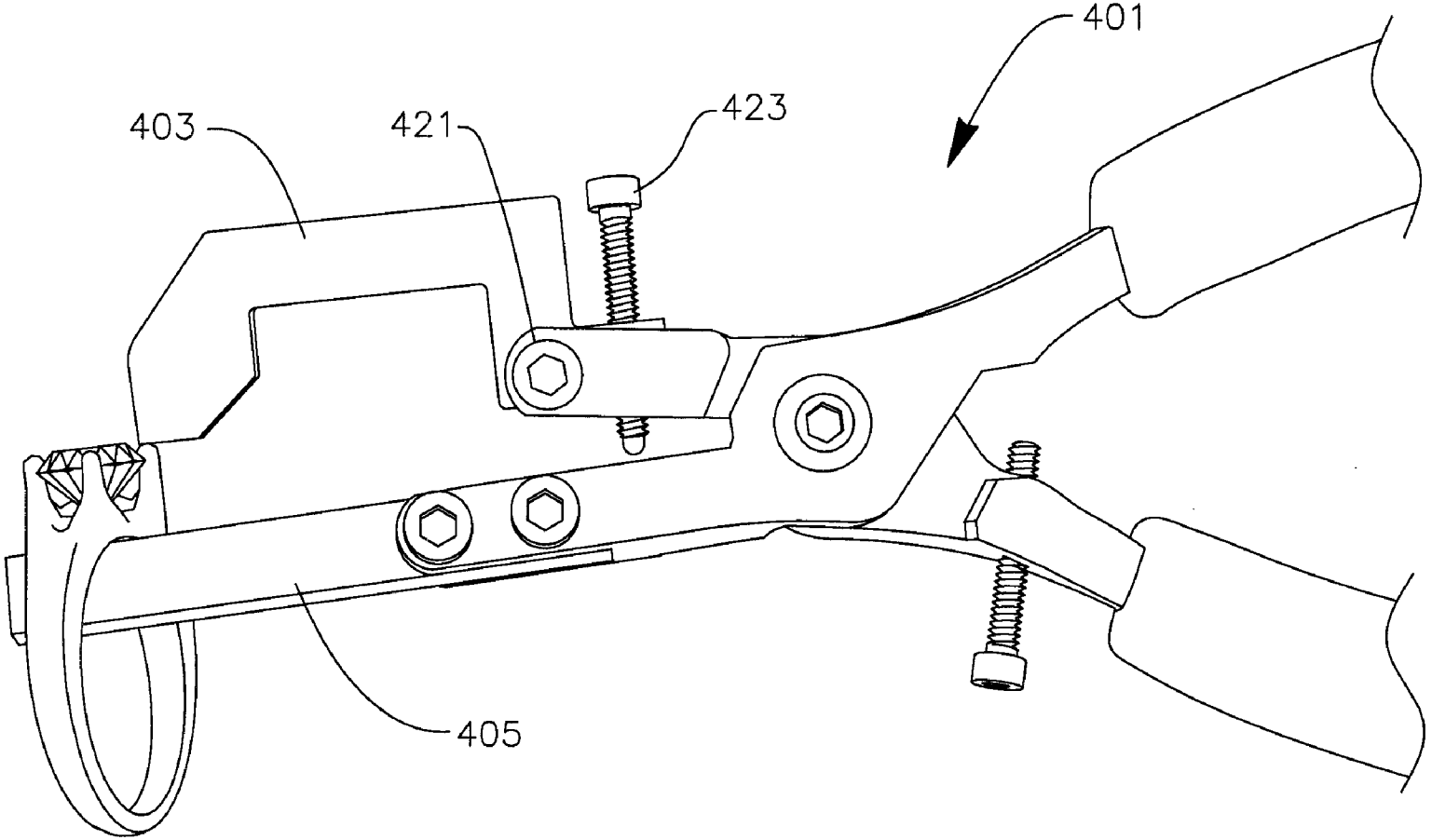

Referring now to FIGS. 4*a* and 4*b*, a setting tool of the present invention is illustrated. These setting tools 400 and 401 each have generally U-shaped upper jaws 402 and 403 and flat or straight lower jaws 404 and 405. Each of the upper jaws 402 and 403 also have a second pivot mechanism 420 and 421 which allow the clamping face or distal end of the jaw to be adjusted within the range provided by adjustment mechanisms 422 and 423. The clamping surfaces in these illustrated embodiments are generally flat but both concave and convex clamping surfaces may be used in alternative embodiments of these upper jaws. Each of the lower jaws 404 and 405 may be solid or may be slotted in order to receive an earring post, for example, during the setting of a stone to be retained in the earring.

In an alternative embodiment of a U-shaped upper jaw (not shown), the distal region of the upper jaw is adjustably attached to the proximal region of the jaw. In one particular embodiment of this adjustable upper jaw, the distal region of the upper jaw has a convex clamping face attached to a rod. The rod is fitted into groove or slot, such as an aligned keyway, in a proximal region of the jaw that contains both the second pivot member and the adjustment member or mechanism. The width of the clamping face from the second pivot member to the clamping face may be adjusted by moving the rod within the aligned keyway. When the width is set to the correct length, a locking screw is used to fix the position of the rod in the keyway when the tool is used.

Figure 5:
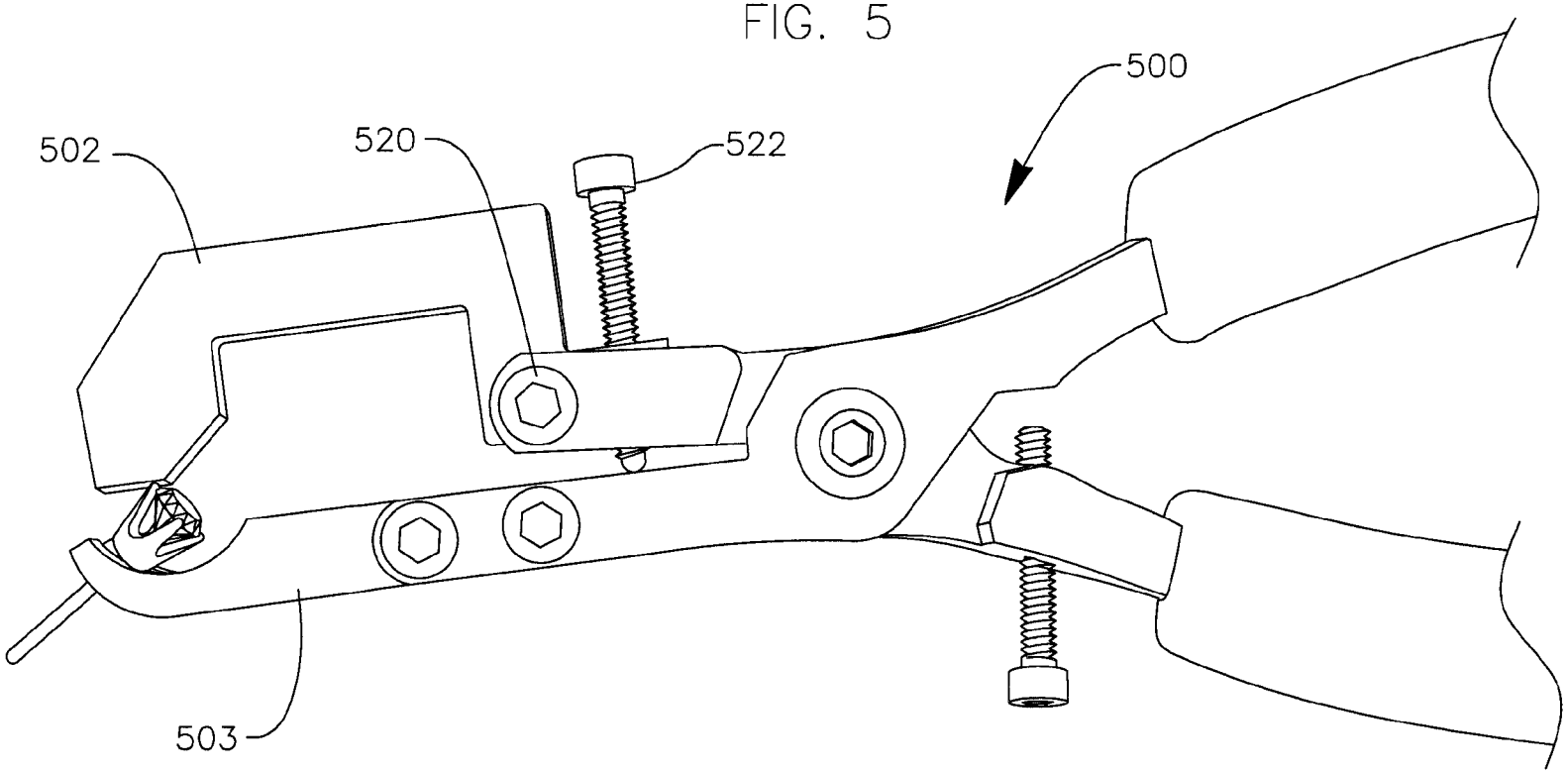
FIG. 5 is a digital image of a setting tool of the present invention with a concave lower clamping face that is slotted to receive an earring post.

Referring now to FIG. 5, still another setting tool of the present invention is illustrated. This setting tool 500 has a generally U-shaped upper jaw 502 with a generally flat clamping surface and a lower jaw 503 with a generally concave clamping surface. Similar to the other embodiments, the upper jaw 502 includes both a second pivot mechanism 520 and an adjustment mechanism 522. The concave portion of the lower jaw 503 is slotted in order to receive an ear post during the setting of a stone to be retained in the earring.

Figure 6:
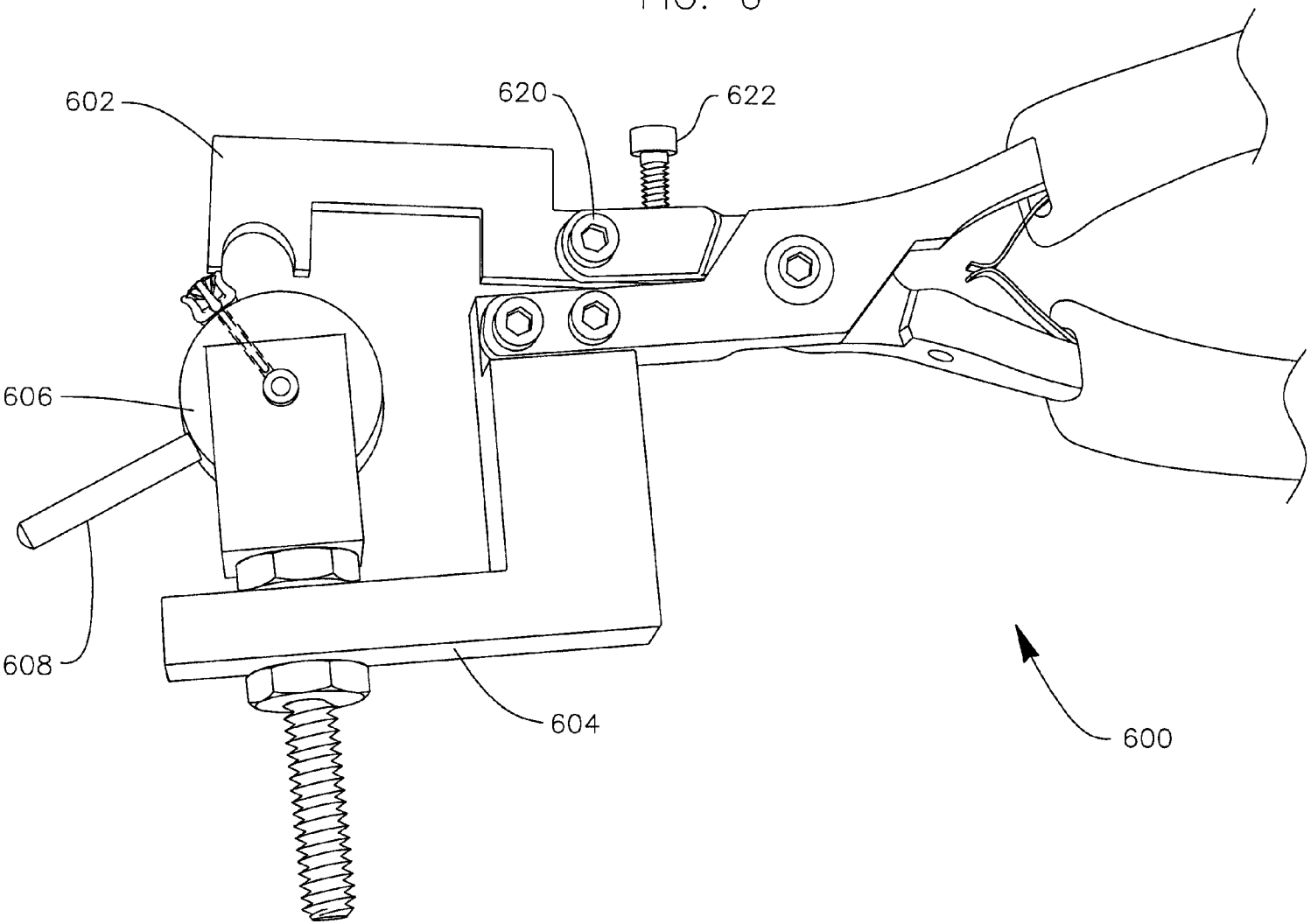
FIG. 6 is a digital image of a setting tool of the present invention with a movable disk-shaped anvil adapted to receive an earring post fitted to a lower jaw.

Referring now to FIG. 6, yet another embodiment of a setting tool of the present invention is illustrated. This setting tool 600 has a generally U-shaped upper jaw 602 where the clamping surface in the distal region of the upper jaw is generally concave and a lower jaw 604 having a clamping surface that is made of a rotatable disk-shaped anvil 606. A slightly flattened edge region of the anvil contains an aperture to receive an earring post. In use, the disk-shaped anvil 606 can be rotated in the order to vary or adjust the angle of the earring prongs in relation to the clamping surface of the upper jaw. A handle 608 fitted to the edge of anvil provides for facile control of the anvil's rotation. The capability of rotating the anvil to adjust the clamping angles allows the tool to used to set different shaped stones in a variety of earring settings. Similar to the other embodiments, the upper jaw 602 includes both a second pivot mechanism 620 and an adjustment mechanism 622.

Figure 7:
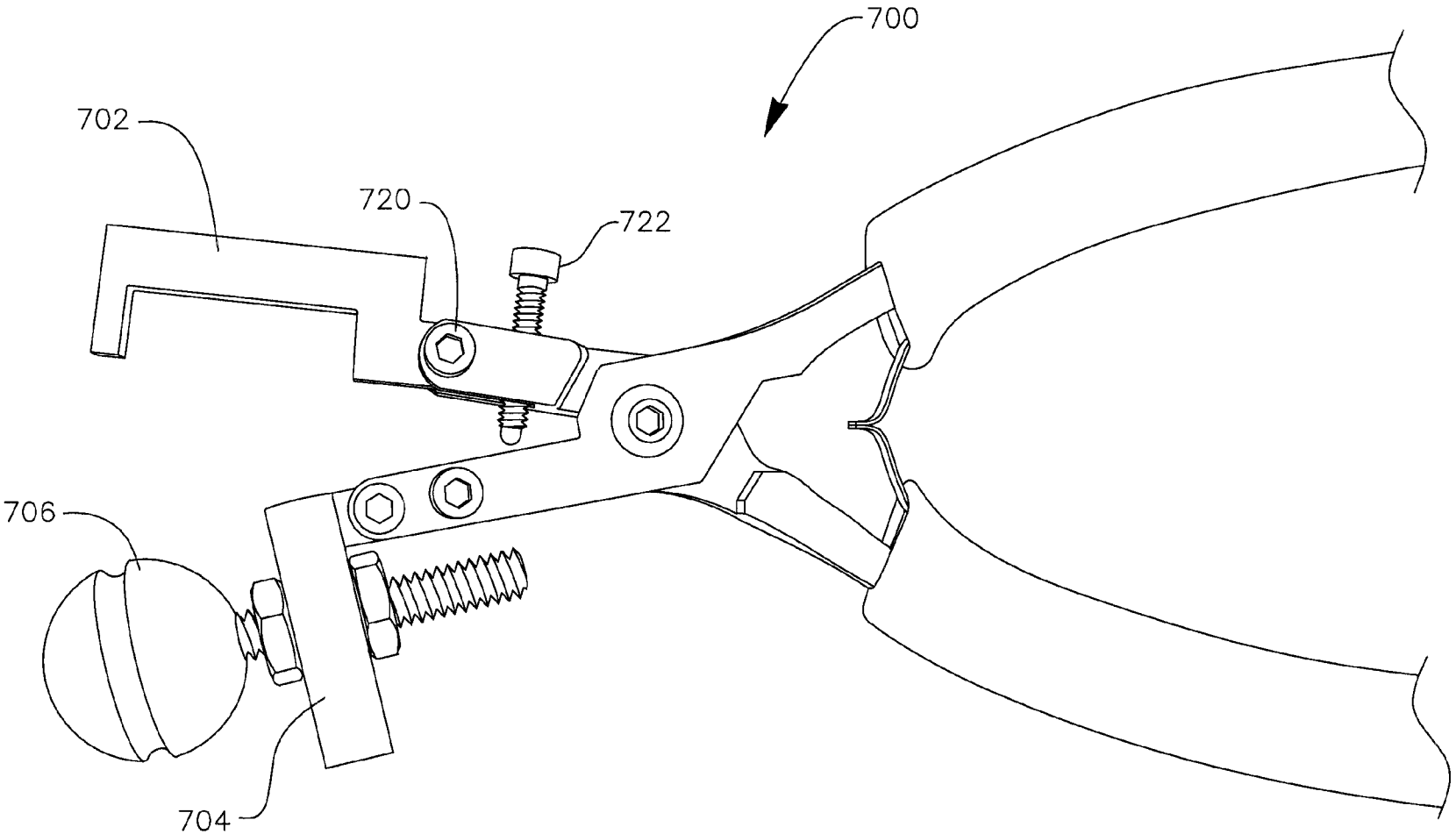
FIG. 7 is a digital image of a setting tool of the present invention with a generally spherical-shaped anvil fitted to a lower jaw.

Referring now to FIG. 7, yet another embodiment of a setting tool of the present invention is illustrated. The setting tool 700 has a generally U-shaped upper jaw 702 where the clamping surface in the distal region of the upper jaw is generally flat and a lower jaw 704 having a clamping surface that is made of a generally spherical anvil 706. In the illustrated embodiment, the spherical anvil 706 also includes a clearance recess around the circumference of the anvil. In use, the spherical anvil 706 may be used to support the inner surface of a ring while the tool is used to set the prongs on the ring to retain a stone in the ring setting. Similar to the other embodiments, the upper jaw 702 includes both a second pivot mechanism 720 and an adjustment mechanism 722.

Figure 8:
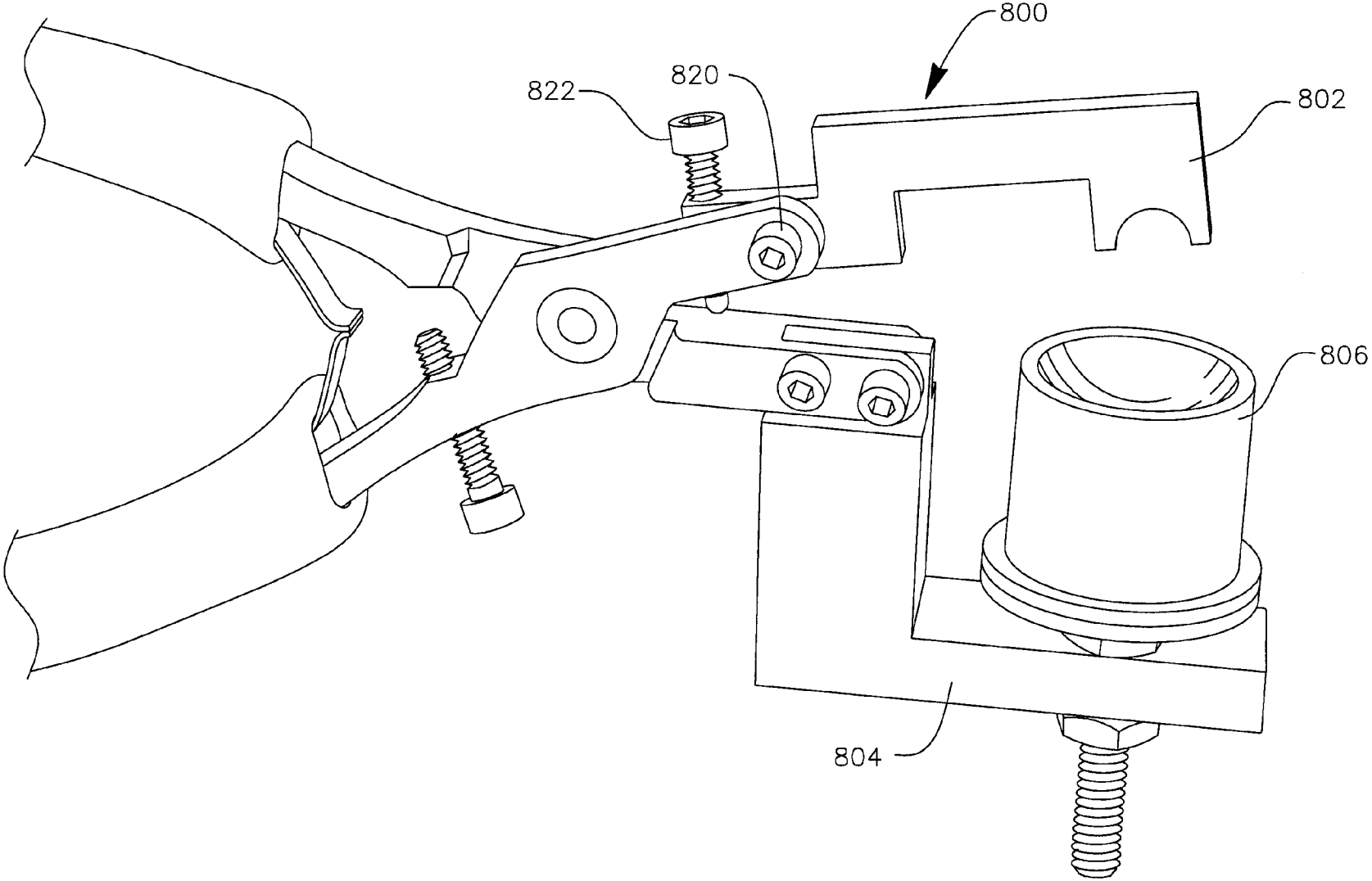
FIG. 8 is a digital image of a setting tool of the present invention with a cup fitted to a lower jaw.

Referring now to FIG. 8, another embodiment of a setting tool of the present invention is illustrated. The setting tool 800 has a generally U-shaped upper jaw 802 where the clamping surface in the distal region of the upper jaw is generally concave and a lower jaw 804 having a clamping surface that is made of a cup 806 adapted to hold a fixturing or setting compound such as JETT SETT fixturing compound. In use, the setting compound retained the cup 806 may be used to support the surfaces of an irregular-shaped work piece while the tool is used to set the prongs on the piece to retain a stone in the work piece's setting. Similar to the other embodiments, the upper jaw 802 includes both a second pivot mechanism 820 and an adjustment mechanism 822.

Figure 9:
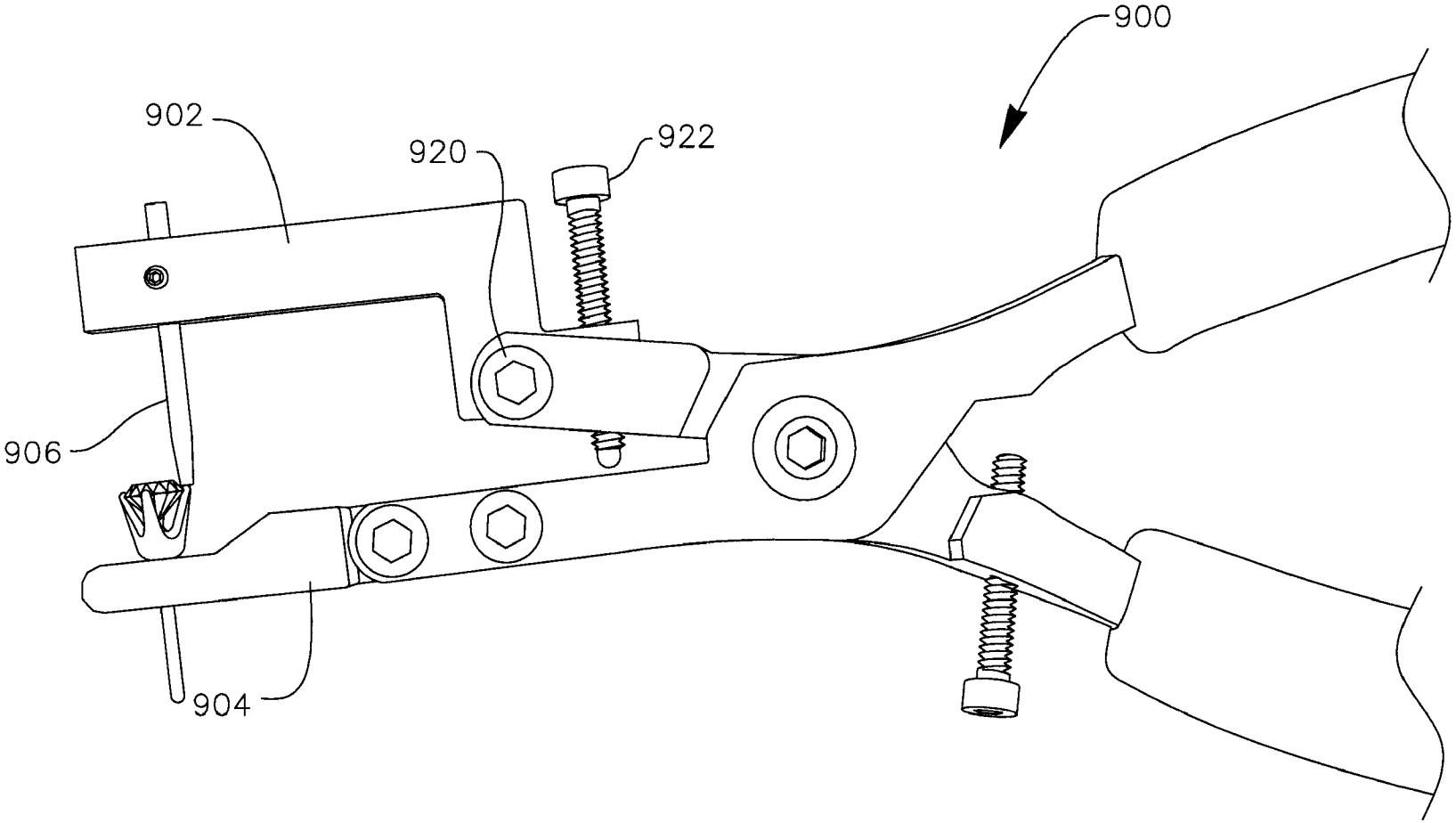
FIG. 9 is a digital image of a setting tool of the present invention with an adjustable setting pin fitted to an upper jaw.

Referring now to FIG. 9, another embodiment of a setting tool of the present invention is illustrated. This setting tool 900 has a generally L-shaped upper jaw 902 where the jaw is fitted with an adjustable setting pin 906 that can be brought into contact with a work piece as the jaws are closed together. The lower jaw 904 of this embodiment has a concave clamping surface. In use, the setting pin 906 can contact the work piece in order to bead set a stone that will be retained by the work piece or alternatively be used to set a rivet or other types of malleable fasteners. Similar to the other embodiments, the upper jaw 902 includes both a second pivot mechanism 920 and an adjustment mechanism 922.

Figure 10:
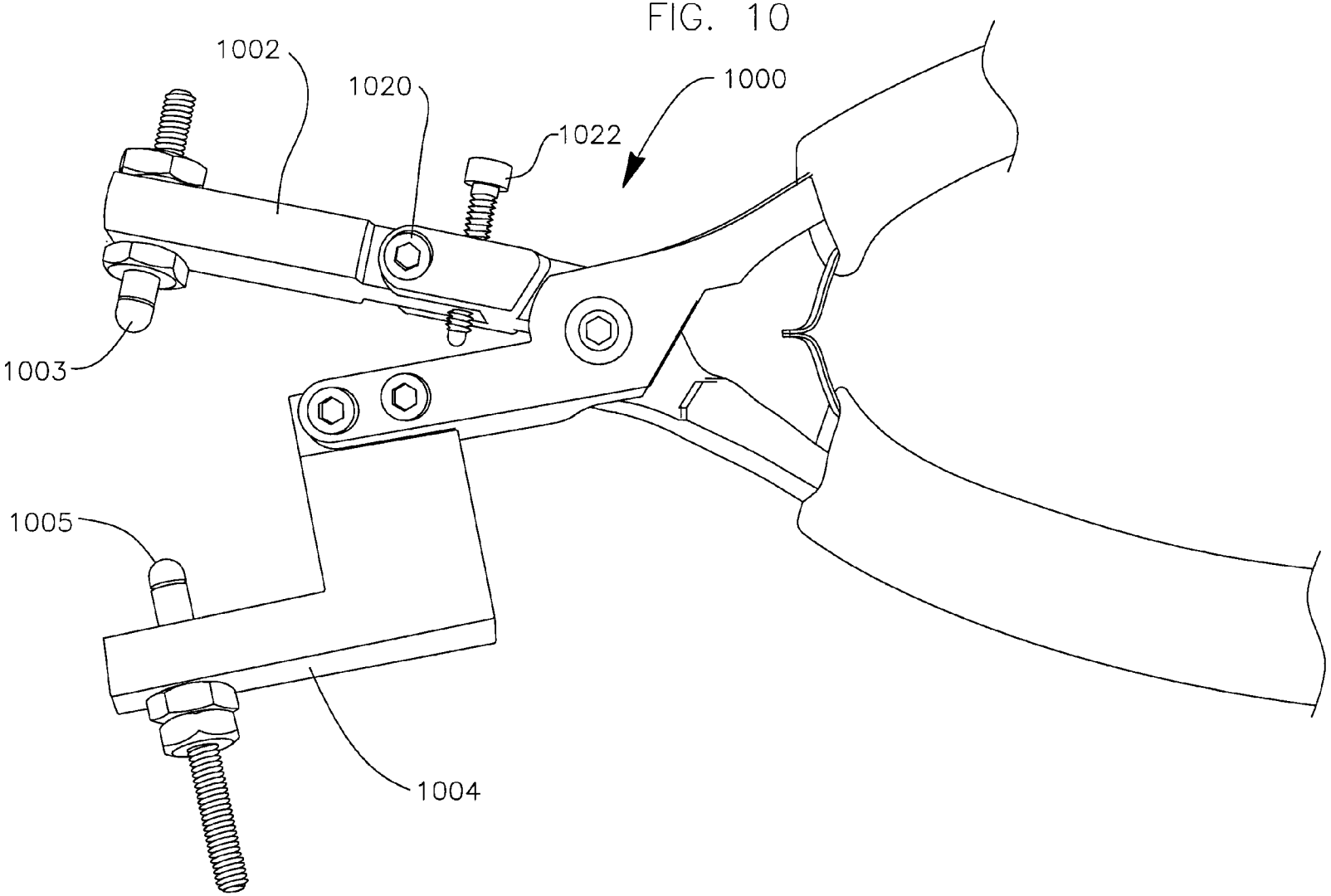
FIG. 10 is a digital image of a setting tool of the present invention having rivet setting structures on both upper and lower jaws.

Referring now to FIG. 10, another embodiment of a setting tool of the present invention is illustrated. This setting tool 1000 has a generally flat or straight upper jaw 1002 fitted with a rounded stud 1003 and a generally L-shaped lower jaw 1004 that is also fitted with a rounded stud 1005. In use, this setting tool is used to flare the ends of a hollow rivet or similar type of malleable fastener used to hold two or more different materials together. Similar to the other embodiments, the upper jaw 1002 includes both a second pivot mechanism 1020 and an adjustment mechanism 1022.

Figure 11:
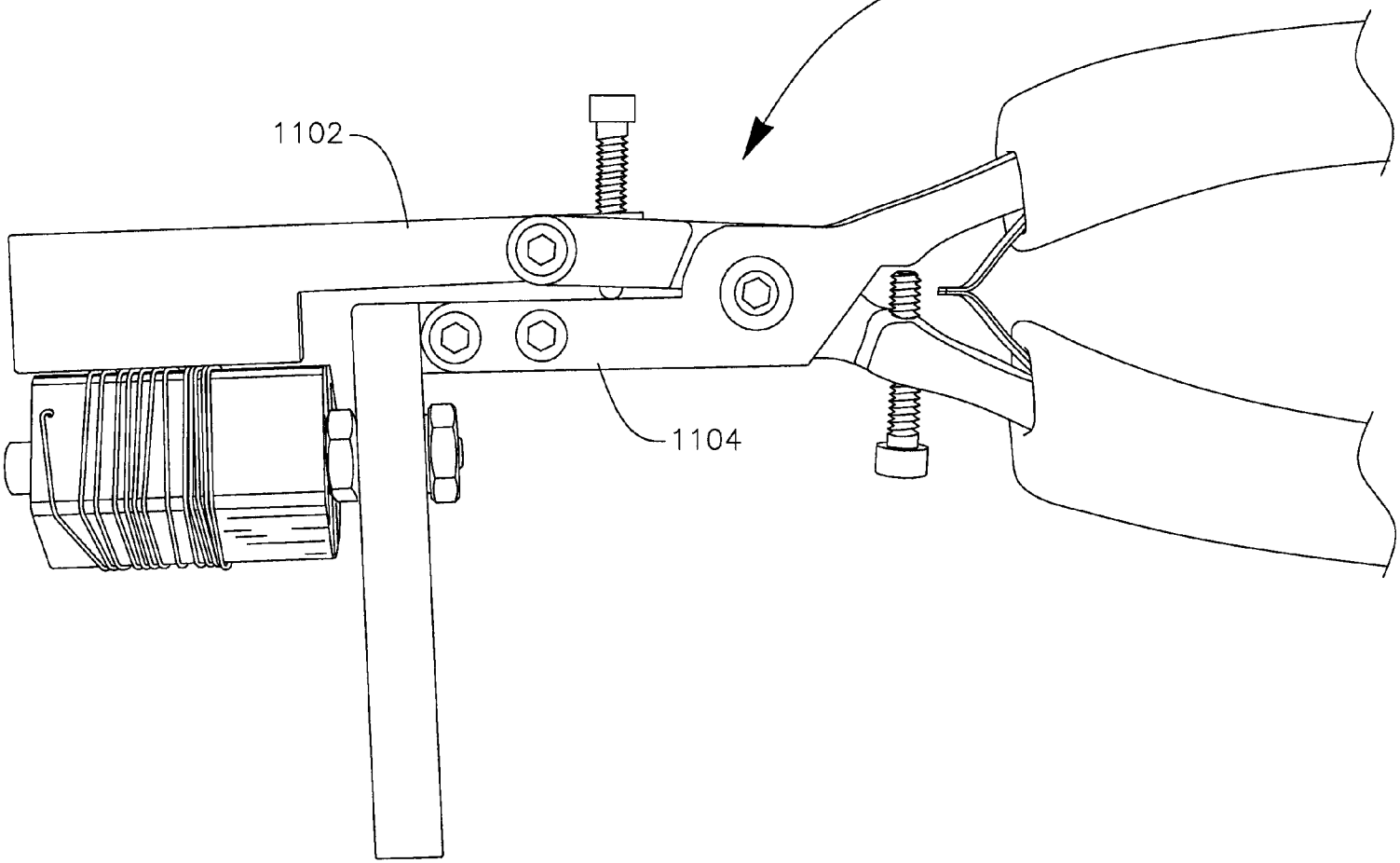
FIG. 11 is a digital image of a wire forming tool of the present invention configured to form straight wire coils.

Referring now to FIG. 11, an embodiment of a wire coil forming tool of the present invention is illustrated. This wire forming tool 1100 has a generally flat or straight upper jaw 1102 that includes both a second pivot mechanism and an adjustment mechanism and lower jaw 1104 fitted with a mandrel having a central or principle axis extending substantially parallel to the principle axis of the handles of the tool. The principle axis of the tool lies in a plan generally defined by the distal tips of the upper and lower jaws and the pivot member joining each of the handles. In the particular embodiment of FIG. 11, the mandrel has a hexagonal cross section. In alternative embodiments, the cross section of the mandrel may be of any shape. In addition, the mandrel may also be tapered to any angle from the proximal base of the mandrel attached to the lower jaw to the distal end of the mandrel.

Figure 12:
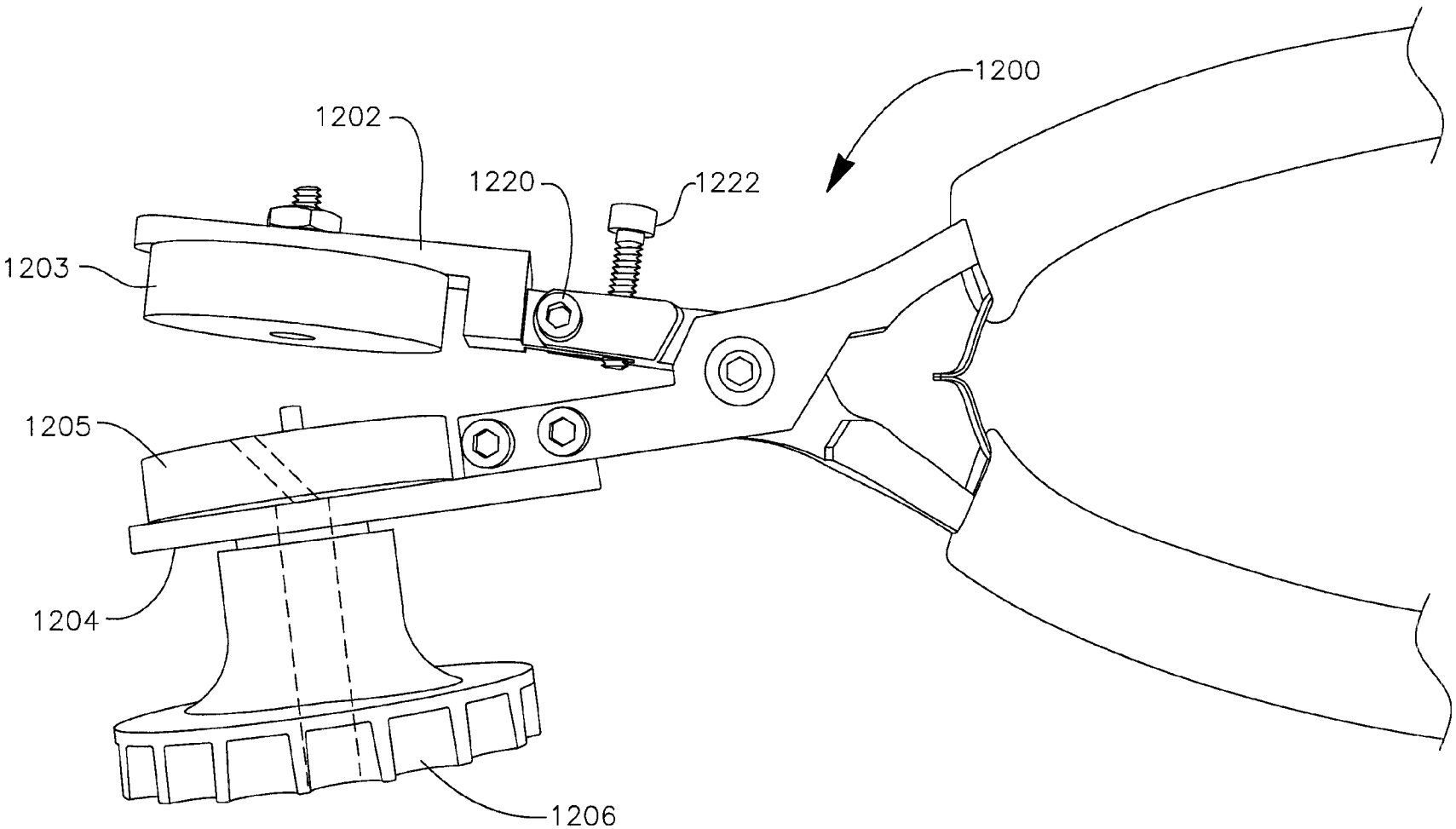
FIG. 12 is digital image of a wire forming tool of the present invention configured to form wire spirals.

Referring now to FIG. 12, an embodiment of a wire spiral forming tool of the present invention is illustrated. This forming tool 1200 has an upper jaw 1202 fitted with a fixed first disk 1203 that has a face that is essentially perpendicular to the principal axis of the tool (the principle axis of the tool lies in a plan generally defined by the distal tips of the upper and lower jaws and the pivot member joining each of the handles). The upper jaw also includes both a second pivot mechanism 1220 and an adjustment mechanism 1222. The tool also has a lower jaw 1204 fitted with a rotatable second disk 1205 that also has a face that is essentially perpendicular to the principal axis of the tool. The second disc is connected to a knob or handle 1206 to facilitate rotating the second disk. In use, the end of a length of wire or other material to be wound is held by a slotted pin attached to the center of the second disk. The faces of the first and second disk are moved together and the second disk is then rotated with the attached knob or handle to wind the wire into a spiral shape.

Figure 13:
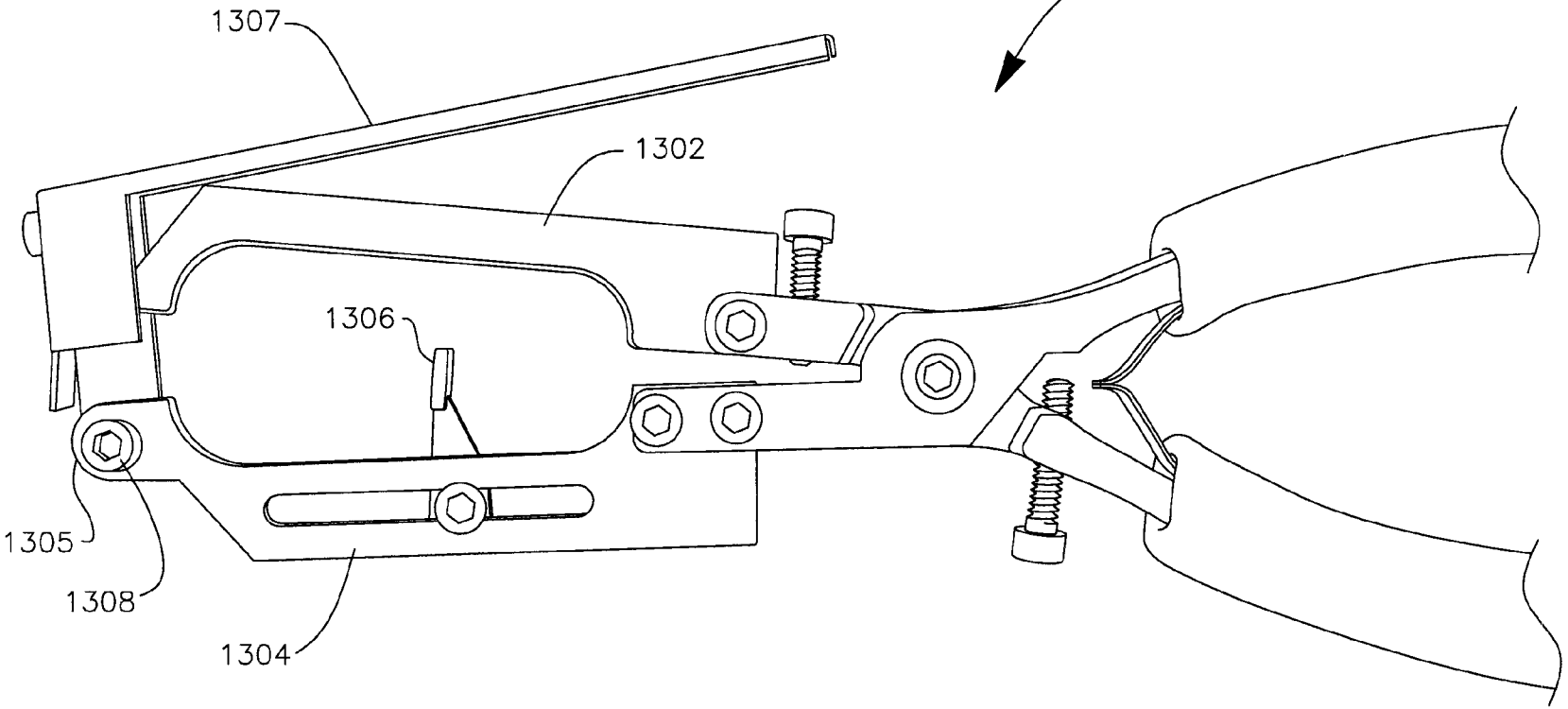
FIG. 13 is a digital image of a wire forming tool of the present invention configured to form a wire earring.
Figure 14A:
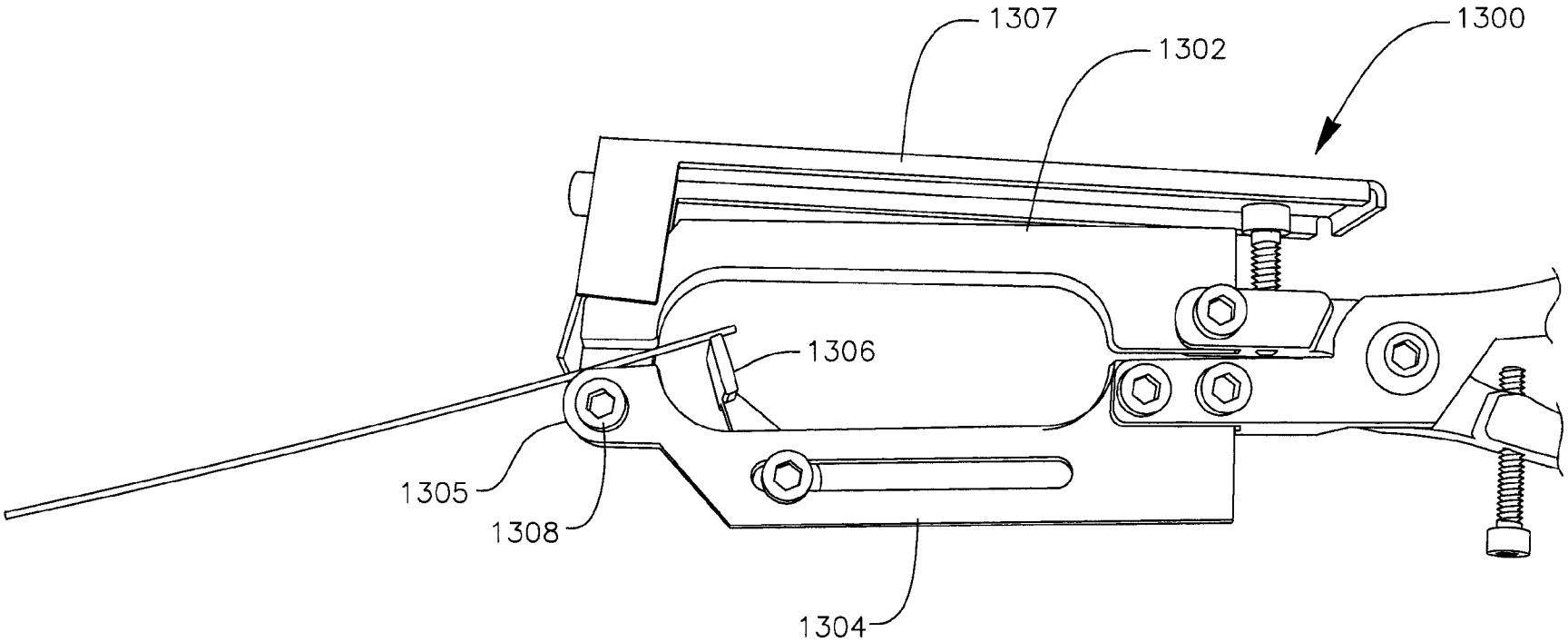
FIGS. 14*a*-14*d* are digital images illustrating using the wire forming tool of FIG. 13 to form a wire earring.
Figure 14B:
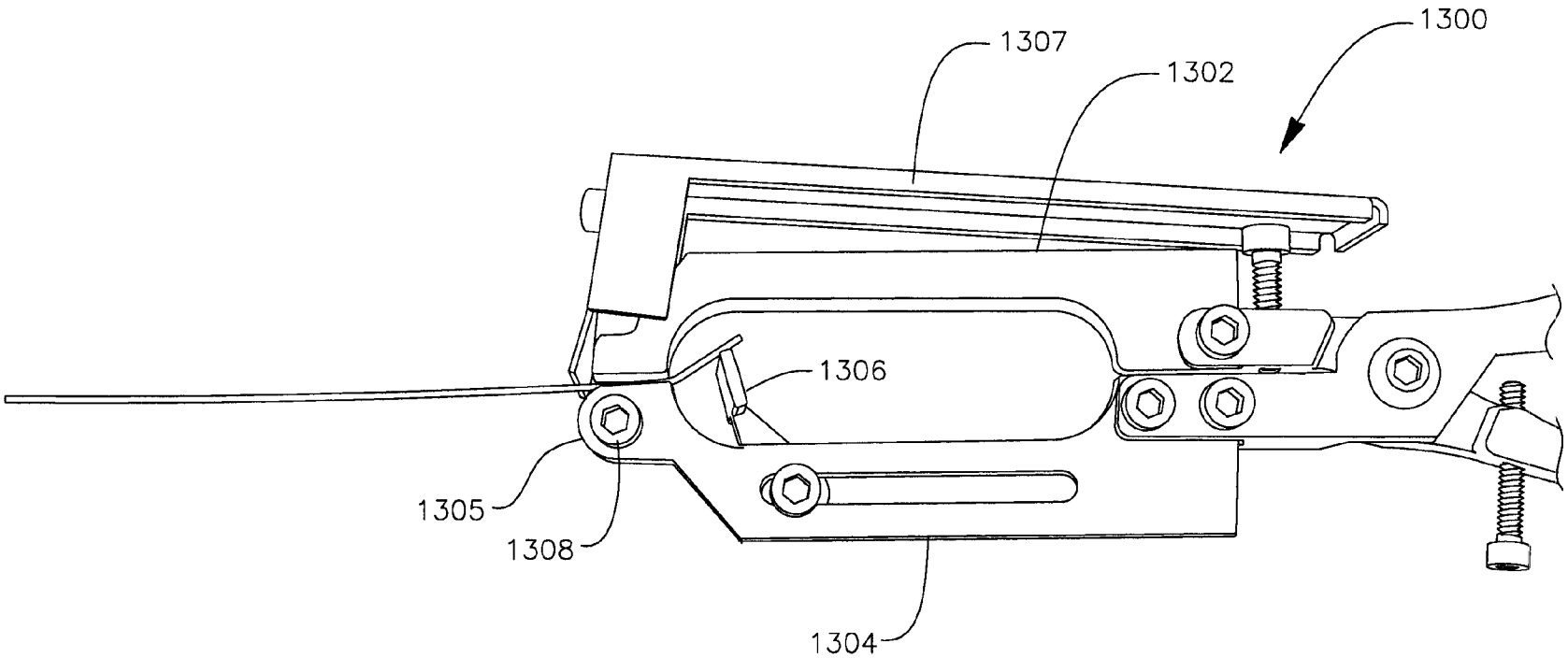
Figure 14C:
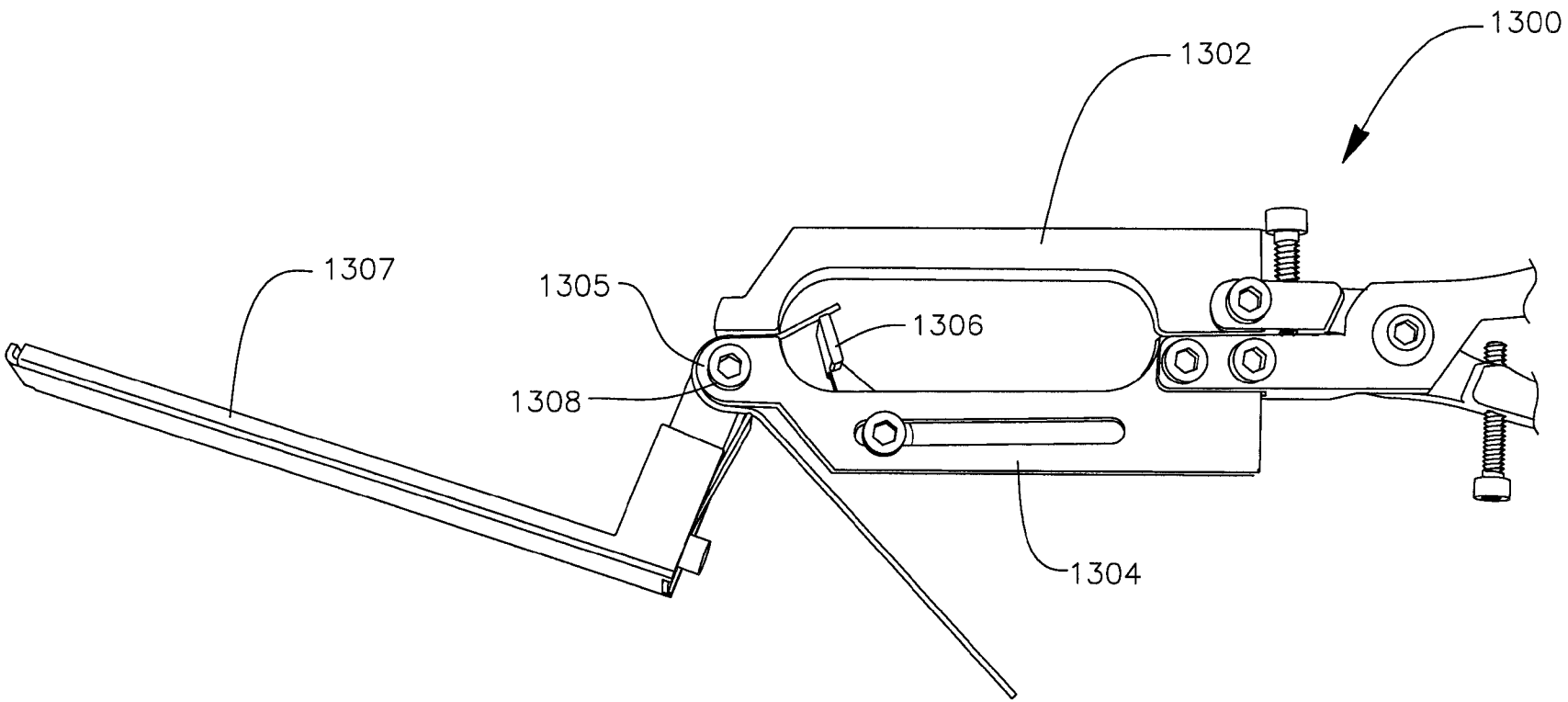
Figure 14D:
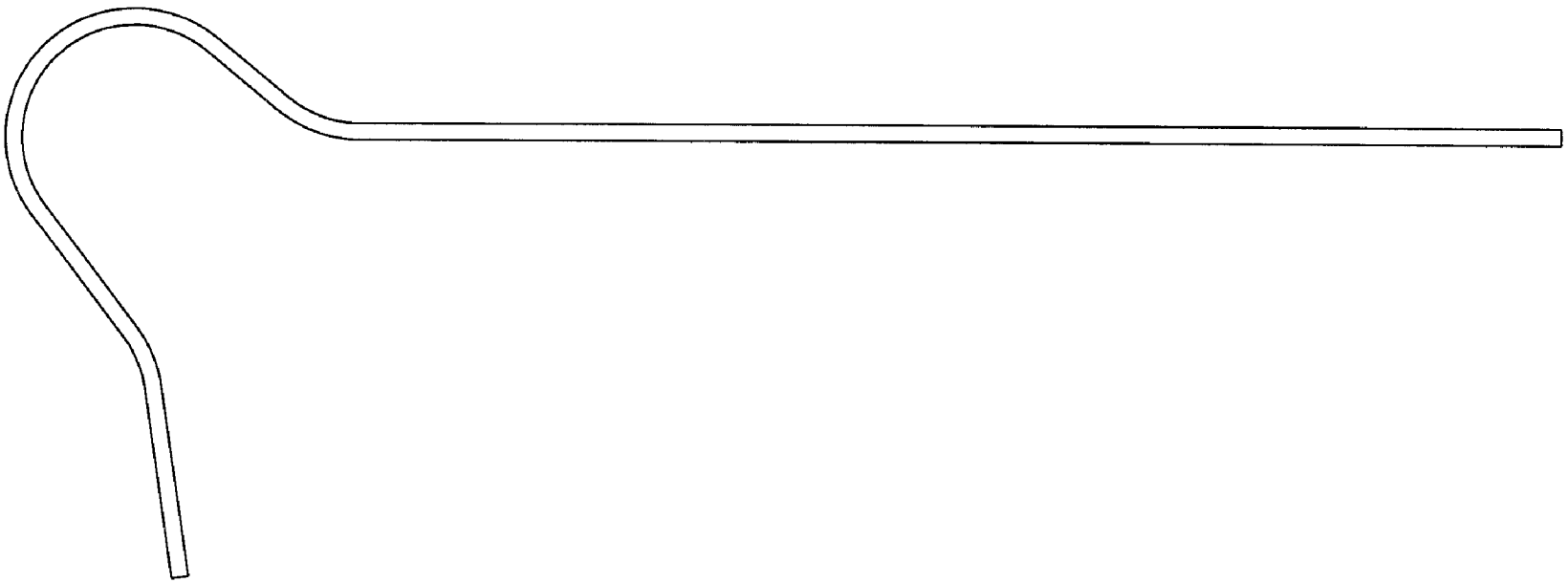

Referring now to FIG. 13, an embodiment of a wire earring forming tool of the present invention is illustrated. This forming tool 1300 has a generally elongate U-shaped upper jaw 1302 with a flat clamping face where the upper jaw also includes both a second pivot mechanism and an adjustment mechanism. The tool also has a generally elongate U-shaped lower jaw 1304 having a flat clamping face, a circular anvil 1305 on the distal end of the lower jaw, an adjustable stop 1306 proximal to a circular anvil and further fitted with a rotatable lever 1307 attached to the lower jaw with a third pivot member 1308. The rotatable lever 1307 has a lip that can rotate over the outer surface of the circular anvil that is adapted to form a wire work piece around the circular anvil to provide a wire earring.

FIGS. 14*a* to 14*d* illustrate the process of forming a wire earring with the forming tool of FIG. 13. In a first step, the end a wire work piece is placed on the adjustable stop that has been set a predetermined distance from the clamping faces of the upper and lower jaws. The upper and lower jaws are then moved to a closed, clamped position to form a first bend near the end of the wire. While the wire is still being help by the upper and lower clamping faces of the tool, a second curved bend is formed in the wire by rotating the lever around the surface of the circular anvil at the distal end of the lower jaw. Once both bends have been formed on the wire, additional sizing and decorative steps can be done to complete the wire earring.

Materials for the jaws used in the present hand-held jewelry tool kit include, but are not limited to stainless steel, titanium and bronze, while materials for the handles include, but are not limited to steels such as AISI 52100, 5160, or C1070.

It is understood that the various embodiments of the present invention are directed to a pliers assembly having a pair of handles, with each handle having a mediate region for mounting a pivot member, a grasping portion located on one side of the mediate region, and a jaw support mount located on the other side of the mediate region. The pliers assembly also has a pivot member for movably securing the mediate regions of the handles together and a pair of jaws each mounted to a respective jaw support mount with each jaw having tab portion adapted to be received by a corresponding slot portion in each handle. Generally, a lower jaw is fixed to one handle and an upper jaw is movable attached to the other handle. The movement of the upper jaw may be adjusted in a range provided by an adjustment mechanism.

This invention is not to be taken as limited to all of the details thereof as modifications and variations thereof may be made without departing from the spirit or scope of the invention.

The invention claimed is:

1. A kit of hand-held jewelry setting and forming tools comprising:

a) one or more pairs of handles, each pair having a first handle with a proximate region for gripping the tool and a distal region adapted to receive a first interchangeable fixed jaw and a second handle with a proximate region for gripping the tool and a distal portion adapted to receive a second interchangeable movable and adjustable jaw, wherein the first and second handles are connected at a first pivot member in a mediate region of each handle; and b) one or more sets of pairs of interchangeable jaws comprising a first interchangeable jaw adapted to be fixedly connected to the first handle and a second interchangeable jaw adapted to be movably connected to a second pivot member in the distal portion of the second handle and adjustable about an adjustment member proximate to the second pivot member, the first jaw having a flat clamping face fitted with an adjustable stop proximal to a circular anvil with an edge to hold a wire on a distal tip of the first jaw, and a rotatable lever attached to the first jaw with a third pivot member where the rotatable lever has a lip over the circular anvil that is adapted to form a wire work piece around the circular anvil and the second jaw having a flat clamping face to hold the wire against the first jaw when the wire work piece is bent by the lever, wherein the adjustment member controls an adjustable clamping angle between the first and second jaws when the jaws are closed to a clamping position on a work piece positioned between the jaws and wherein the adjustable stop forms a bend in the wire when the first and second jaws are closed.

2. The kit of claim 1, wherein the interchangeable first and second jaws each contains a proximal tab that are configured to slide into an associated slot in the distal region of each of the first and second handles.

3. The kit of claim 1, wherein the adjustment member is adjustable within a predetermined range to position the clamping surfaces of the first and second jaws to be substantially parallel when a work piece is positioned between the jaws and the jaws are closed to contact the work piece.

4. The kit of claim 1, comprising an additional set of interchangeable jaws including a third fixed flat nose jaw and fourth movable and adjustable flat nose jaw.

5. The kit of claim 1, comprising an additional set of interchangeable jaws including a third fixed chain nose jaw and fourth movable and adjustable chain nose jaw.

6. The kit of claim 1, comprising an additional set of interchangeable jaws including a third fixed round nose jaw and fourth movable and adjustable round nose jaw.

7. The kit of claim 1, comprising an additional set of interchangeable jaws including a third fixed jaw containing first and fourth clamping faces adapted to support prongs holding a stone in an earring and having a slot between the first and second clamping faces adapted to receive an earring post and a second movable and adjustable jaw containing a clamping face adapted to bend one or more prongs retaining a stone in the earring when the third and fourth jaws are moved to the clamped position.

8. The kit of claim 7, wherein each of the clamping faces of the third jaw are substantially flat.

9. The kit of claim 7, wherein each of the clamping faces of the third jaw are at least partially concave.

10. The kit of claim 7, wherein the clamping face of the fourth jaw is substantially flat.

11. The kit of claim 7, wherein the clamping face of the fourth jaw has a flat distal region, a concave mediate region and a flat proximate region.

12. The kit of claim 1, comprising an additional set of interchangeable jaws including a third fixed jaw and a fourth movable and adjustable jaw, the third fixed jaw having a rotatable, circular disk-shaped anvil with a pair of faces substantially parallel to a plane defined by the distal tips of the third and fourth jaws in an open position and the third pivot member so that an edge of the disk-shaped anvil is a clamping face for the first jaw and where the disk-shaped anvil has a flattened edge region containing an aperture adapted to receive an earring post and the fourth movable and adjustable jaw containing a clamping face having a distal flat region, a mediate concave region and a flat proximal region and adapted to bend one or more prongs retaining a stone in the earring when the third and fourth jaws are moved to a clamped position.

13. The kit of claim 1, comprising an additional set of interchangeable jaws including a third fixed jaw having a generally spherical anvil adapted to support an inner surface of a ring and a fourth movable and adjustable second jaw containing clamping face having a concave face and positioned to bend one or more prongs retaining a stone in the ring when the third and fourth jaws are moved to the clamped position.

14. The kit of claim 1, comprising an additional set of interchangeable jaws including a third fixed jaw having a spherical anvil adapted to support an inner surface of a ring and fourth movable and adjustable second jaw containing a fixed pin adapted to bend a prong retaining a stone in the ring, to bead set a stone in the ring or to set a rivet in the ring when the third and fourth jaws are moved to the clamped position.

15. The kit of claim 1, comprising an additional set of interchangeable jaws including a third fixed jaw having an elongated, substantially flat clamping face adapted to support an inner surface of a ring and a fourth movable and adjustable second jaw containing a flat clamping face adapted to bend a prong retaining a stone in the ring when the third and fourth jaws are moved to a clamped position.

16. The kit of claim 1, comprising an additional set of interchangeable jaws including a third fixed jaw having an elongated, substantially flat clamping face adapted to support an inner surface of a ring and fourth movable and adjustable second jaw containing a pin adapted to bend a prong retaining a stone in the ring, to bead set a stone in the ring or to set a rivet in the ring when the third and fourth jaws are moved to a clamped position.

17. The kit of claim 1, comprising an additional set of interchangeable jaws including a third fixed jaw and a fourth movable and adjustable jaw, the third fixed jaw fitted with a cup adapted to support a setting material to hold an irregular shaped article containing prongs to hold a stone with an opening in the cup facing a clamping face of the fourth jaw and the fourth movable and adjustable second jaw containing a flat clamping face adapted to bend a prong holding a stone in the irregular article when the third and fourth jaws are moved to a clamped position.

18. The kit of claim 1, comprising an additional set of interchangeable jaws including a third fixed jaw and a fourth movable and adjustable jaw, the third fixed jaw having a cylindrical mandrel with a cylindrical axis substantially parallel to a plane defined by both distal tips of the third and fourth jaws in an open position and the first pivot member and the fourth movable and adjustable jaw containing a clamping face to contact a wire work piece wrapped on the cylinder when the third and fourth jaws are closed.

19. The kit of claim 1, comprising an additional set of interchangeable jaws including a third fixed jaw and a fourth movable and adjustable jaw, the third fixed jaw having a tapered mandrel with a central axis substantially parallel to a plane defined by both distal tips of the third and fourth jaws in an open position and the first pivot member and the fourth movable and adjustable jaw containing a clamping face to contact a wire work piece wrapped on the mandrel when the third and fourth jaws are closed.

20. The kit of claim 1, comprising an additional set of interchangeable jaws including a third fixed jaw and a fourth movable and adjustable jaw, the third fixed jaw fitted with a rotatable first disk with a face essentially perpendicular to a plane defined by both distal tips of the third and fourth jaws in an open position and the first pivot member, wherein a slotted pin adapted to receive the end of a wire work piece is fitted in the center of the first disk; and the fourth movable and adjustable jaw containing a fixed second disk with a face essentially perpendicular to a plane defined by both distal tips of the third and fourth jaws in an open position and the first pivot member, wherein the first and second disks are adapted to hold a portion of a wire work piece and produce a spiral wound coil by rotating the disk on the third jaw.

21. A jewelry tool comprising:

a) a pair of handles;

b) a pair of jaws, each of the pair of handles having a proximate portion for gripping the tool and a distal portion receiving a jaw, the pair of jaws having a fixed first a movable second jaw, wherein the first and second handles are connected at a first pivot member in a mediate region of each handle;

wherein the first jaw is fixedly connected to the first handle and the second jaw is movably connected to a second pivot member in the distal portion of the second handle and adjustable about an adjustment member proximate to the second pivot, the first jaw having a flat clamping face fitted with an adjustable stop proximal to a circular anvil with an edge to hold a wire on a distal tip of the first jaw and the second jaw having a flat clamping face to hold the wire against the first jaw when the wire work piece is bent by the lever, wherein the adjustment member controls an adjustable gripping angle between the first and second jaws when the jaws are closed to contact a work piece between the jaws and wherein the adjustable stop forms a bend in the wire when the first and second jaws are closed; and c) a rotatable lever attached to the first jaw with a third pivot member and movable about the third pivot member to form a wire work piece around the circular anvil when the lever is moved about the third pivot member.

* * * * *

UNITED STATES PATENT AND TRADEMARK OFFICE

CERTIFICATE OF CORRECTION

PATENT NO. : 7,814,817 B1
APPLICATION NO. : 11/969798
DATED : October 19, 2010
INVENTOR(S) : Timothy W. Sheriff It is certified that error appears in the above-identified patent and that said Letters Patent is hereby corrected as shown below:

Column 6

Line 46
Replace the word "fourth" with the word -- second --

Line 49
Replace the word "second" with the word -- fourth --

Line 67
Replace the second occurrence of the word "third" with the word -- first --

Column 7

Line 2
Replace the word "first" with the word -- third --

Line 13
Delete the word "second"

Line 21
Delete the word "second"

Line 29
Delete the word "second"

Line 36
Delete the word "second"

Signed and Sealed this
Twenty-first Day of February, 2012

David J. Kappos

David J. Kappos
*Director of the United States Patent and Trademark Office*

Line 46
Delete the word “second”